US009689532B2

(12) United States Patent
Barbato et al.

(10) Patent No.: US 9,689,532 B2
(45) Date of Patent: Jun. 27, 2017

(54) RECONFIGURABLE AND SCALABLE COMPRESSED NATURAL GAS REFILLING STATION

(71) Applicant: Parker-Hannifin Corporation, Cleveland, OH (US)

(72) Inventors: Vincenzo Barbato, Richmond, TX (US); Billy J. Jackson, Jr., Spring, TX (US)

(73) Assignee: Parker-Hannifin Corporation, Cleveland, OH (US)

( * ) Notice: Subject to any disclaimer, the term of this patent is extended or adjusted under 35 U.S.C. 154(b) by 385 days.

(21) Appl. No.: 14/473,310

(22) Filed: Aug. 29, 2014

(65) Prior Publication Data

US 2015/0059863 A1 Mar. 5, 2015

Related U.S. Application Data

(60) Provisional application No. 61/871,696, filed on Aug. 29, 2013.

(51) Int. Cl.
*B65B 1/04* (2006.01)
*F17C 5/06* (2006.01)

(52) U.S. Cl.
CPC ..... *F17C 5/06* (2013.01); *F17C 2201/0109* (2013.01); *F17C 2201/056* (2013.01); *F17C 2201/058* (2013.01); *F17C 2205/037* (2013.01); *F17C 2221/033* (2013.01); *F17C 2223/0123* (2013.01); *F17C 2223/036* (2013.01); *F17C 2227/0157* (2013.01);
(Continued)

(58) Field of Classification Search
CPC ..... F17C 5/06; F17C 2227/0157; F17C 2205/037; Y10T 137/474
See application file for complete search history.

(56) References Cited

U.S. PATENT DOCUMENTS

| | | | |
|---|---|---|---|
| 4,527,600 | A | 7/1985 | Fisher et al. |
| 6,732,769 | B2 | 5/2004 | Del Campo |
| 7,763,087 | B2 | 7/2010 | Hajiaghajani et al. |

(Continued)

OTHER PUBLICATIONS

CNG Dispensers Natural Gas Technologies. Catalogue [online]. Galileo Technologies [retrieved Aug. 7, 2014]. Retrieved from the Internet: <URL: www.galileoar.com/en/cng-compression/related-documents/1/1/4.html>.

(Continued)

*Primary Examiner* — Jason K Niesz
(74) *Attorney, Agent, or Firm* — Renner, Otto, Boisselle & Sklar, LLP

(57) ABSTRACT

A reconfigurable and scalable fluid distribution system including a compression unit, a storage unit, and a control unit. The compression unit, storage unit and the control unit are in fluid, electronic and electrical communication with one another and are coupled together in a stacked relationship, each in abutting relation to the next. Additional compression, storage and/or control units may be coupled in abutting relationship to an existing stack of coupled units. A method of assembling a reconfigurable and scalable fluid distribution system. A method of dispensing fluid via a reconfigurable and scalable fluid distribution system. A control unit for use in a reconfigurable and scalable fluid distribution system.

19 Claims, 8 Drawing Sheets

(52) U.S. Cl.
CPC ... *F17C 2270/0745* (2013.01); *Y10T 137/048* (2015.04); *Y10T 137/474* (2015.04)

(56) References Cited

U.S. PATENT DOCUMENTS

| | | | | |
|---|---|---|---|---|
| 2008/0147332 | A1 | 6/2008 | Arikara | |
| 2009/0071565 | A1 | 3/2009 | Ding | |
| 2013/0190901 | A1 | 7/2013 | Ko et al. | |
| 2015/0129082 | A1* | 5/2015 | Murphy | F17C 5/06 141/4 |

OTHER PUBLICATIONS

Femtobox. Datasheet [online]. Galileo Technologies [retrieved Aug. 7, 2014]. Retrieved from the Internet: <URL: www.galileoar.com/en/cng-compression/femtobox.html>.

Galileo Compression Systems Microbox Core Series. Catalogue [online]. Galileo Technologies [retrieved Aug. 7, 2014]. Retrieved from the Internet: <URL: www.galileoar.com/en/cng-compression/related-documents/1/1/2.html>.

Galileo Nanobox. Catalogue [online]. Galileo Technologies [retrieved Aug. 7, 2014]. Retrieved from the Internet: <URL: www.galileoar.com/en/cng-compression/related-documents/1/1/3.html>.

* cited by examiner

RECONFIGURABLE AND SCALABLE COMPRESSED NATURAL GAS REFILLING STATION

RELATED APPLICATIONS

This application claims the benefit of U.S. Provisional Application No. 61/871,696 filed Aug. 29, 2013, which is hereby incorporated herein by reference.

FIELD OF INVENTION

The present invention relates generally to a compressed natural gas refilling station, and more particularly to a reconfigurable and scalable compressed natural gas refilling station.

BACKGROUND

Compressed natural gas (CNG) refilling stations involve receiving gas from a natural gas feed line, compressing the gas up to a predetermined pressure and then either dispensing the compressed gas directly or storing the compressed gas for later dispensing. Traditionally, these stations are either custom-designed to accommodate specific site conditions and project locations or consist of pre-fabricated systems including a predetermined and fixed number of compressors, storage tanks and dispensers.

SUMMARY OF INVENTION

The present invention provides a reconfigurable and scalable compressed natural gas (CNG) refilling station. The refilling station includes one or more compression units for compressing fluid, one or more storage units for storing the compressed fluid, and one or more control units for dispensing the compressed fluid, the units being in fluid, electronic and electrical communication with one another and being in a stacked relationship with one another. The design allows for reconfiguration, where additional units can be added (stacked) to increase compression, storage, or dispenser capacity as needed. The design also allows for units to be easily replaced and/or maintained and arranged to accommodate for location constraints.

According to one aspect of the invention, a reconfigurable and scalable fluid distribution system is provided that includes a compression unit including an inlet for receiving fluid from a fluid source, a compressor for compressing the fluid, and an outlet through which the compressed fluid exits the compression unit a storage unit including an inlet for receiving compressed fluid, a storage tank for storing the compressed fluid, and an outlet through which the compressed fluid exits the storage unit, and a control unit including an inlet for receiving compressed fluid, an outlet through which the compressed fluid exits to a dispensing hose, and a controller for communicating with the compression unit and the storage unit; wherein the compression unit, the storage unit and the control unit are configured to be in fluid, electronic and electrical communication with one another and are configured to be coupled together in a stacked relationship, each in abutting relation to the next and are configured to allow additional compression, storage and/or control units to be coupled in abutting relationship to an existing stack of coupled units.

The compression unit, the storage unit and the control unit may further include a housing, wherein the housing comprises a frame and sheathing, and wherein the sheathing comprises apertures arranged in a pattern such that, when one unit is coupled to another unit in a stacked, abutting relationship, the apertures of one unit align with the apertures of the other unit. The housing may further include a roof to protect the components and connections within the unit from the elements. The roof may be ventilated to allow for the escape of fluid in case of a leak.

The units may further be configured to be coupled together via mechanical connections between their respective housings The units may further be configured to include a power supply conduit, a data conduit, a pipe for compressed fluid, and a pipe for fluid from the fluid source.

The units may further be configured to be placed into fluid, electronic and electrical communication with one another via connections between their respective conduits and pipes.

The connections may include couplings configured to automatically connect when one unit is brought into stacked, abutting relationship to another.

The compression unit, the storage unit and the control unit may include a control valve configured to be controlled by the controller to direct the flow of fluid through the system.

The compression unit may include a control valve at an outlet of the compressor configured to be controlled by the controller to allow compressed fluid to exit the compressor and the controller may be configured to turn the compressor on and off.

One or more storage units may include a control valve at an inlet of the storage tank and a control valve at an outlet of the storage tank, the control valves being configured to be controlled by the controller to allow compressed fluid to enter/exit the storage tank.

According to another aspect of the invention, there is provided a method for assembling a reconfigurable and scalable fluid distribution system including a compression unit, a storage unit, and a control unit; the compression unit including an inlet for receiving fluid from a fluid source, a compressor for compressing the fluid, and an outlet through which the compressed fluid may exit the compression unit; the storage unit including an inlet for receiving the compressed fluid, a storage tank for storing the compressed fluid, and an outlet through which the compressed fluid may exit the storage unit; and the control unit including an inlet for receiving the compressed fluid, an outlet through which the compressed fluid may exit to a dispensing hose, and a controller for communicating with the compression units and the storage unit. The method includes the steps of (a) coupling the compression unit, the storage unit and the control unit together in a stacked relationship, each in abutting relation to the next; and (b) placing the compression unit, the storage unit and the control unit into fluid, electronic and electrical communication with one another.

The coupling step may further include connecting the units mechanically via a housing of each unit, wherein the housing includes a frame and sheathing, and wherein the sheathing includes apertures arranged in a pattern such that, when one unit is coupled to another unit in a stacked, abutting relationship, the apertures of one unit align with the apertures of the other unit. The housing may further include a roof to protect the components and connections within the unit from the elements. The roof may be ventilated to allow for the escape of fluid in case of a leak.

The placing step may further include connecting the units fluidically, electronically and electrically. The units may be connected via a power supply conduit, a data conduit, a pipe for compressed fluid and a pipe for fluid from the fluid source disposed in each unit. The connections may include couplings configured to automatically connect when one unit is brought into stacked, abutting relationship to another.

The compression unit, the storage unit and the control unit may include a control valve controlled by the controller to direct the flow of fluid through the system.

The compression unit may include a control valve at an outlet of the compressor, and the method may further include the step of controlling the control valve via the controller to regulate the flow of compressed fluid out of the compressor and controlling power to the compressor via the controller to turn the compressor on and off.

The storage unit may include a control valve at an inlet of the storage tank and a control valve at an outlet of the storage tank, and the method may further include the step of controlling the control valves via the controller to regulate the flow of compressed fluid to and from the storage tank.

According to another aspect of the invention, there is provided a method of distributing fluid via a reconfigurable and scalable fluid distribution system comprising the steps of (a) placing a compression unit, a storage unit and a control unit into fluid, electronic and electrical communication with one another, (b) connecting the units together in a stack, each in abutting relation to the next, (c) connecting a fluid source to the stack, (d) compressing the fluid using the compression unit, (e) storing the compressed fluid in the storage unit, and (f) distributing the compressed fluid from the control unit.

The method may further include the step of (g) operating control valves disposed in the compression unit and the storage unit to control the compression, storage and distribution of the fluid using a controller disposed in the control unit.

According to another aspect of the invention, there is provided a control unit for a reconfigurable and scalable fluid distribution system including a housing having an inlet for receiving compressed fluid from a storage tank and/or a compressor and an outlet through which the compressed fluid may exit to a dispensing hose, a mass flow meter disposed in the housing for measuring the amount of fluid exiting the outlet, a valve disposed in the housing for controlling the flow of fluid into and out of the storage tank and/or out of the compressor, and a controller disposed in the housing for controlling the valve.

The housing may further include a frame and sheathing, and the sheathing may include apertures. The housing may further include a roof to protect the components and connections within the unit from the elements. The roof may be ventilated to allow for the escape of fluid in case of a leak.

The control unit may be configured to be in fluid, electronic and electrical communication with a compression unit and/or a storage unit, wherein the compression unit includes an inlet for receiving fluid from a fluid source, a compressor for compressing the fluid, and an outlet through which the compressed fluid may exit the compression unit, wherein the storage unit includes an inlet for receiving compressed fluid, a storage tank for storing the compressed fluid, and an outlet through which the compressed fluid may exit the storage unit, and wherein the control unit, the compression unit, and the storage unit are configured to be coupled together in a stacked relationship, each in abutting relation to the next.

According to another aspect of the invention, there is provided a compression unit for a reconfigurable and scalable fluid distribution system including a housing including a frame and sheathing and having an inlet for receiving fluid from a fluid source and an outlet through which compressed fluid may exit the compression unit, a compressor disposed within the housing for compressing the fluid, and a power supply conduit, a data conduit, a pipe for compressed fluid, and a pipe for fluid from the fluid source disposed within the housing, wherein the compression unit is configured such that multiple compression units may be placed in fluid, electronic and electrical communication with one another via the conduits and pipes, and wherein the compression unit is configured such that multiple compression units may be mechanically coupled together in a stacked relationship, each in abutting relation to the next via the housing. The housing may further include a roof to protect the components and connections within the unit from the elements. The roof may be ventilated to allow for the escape of fluid in case of a leak.

The foregoing and other features of the invention are hereinafter described in greater detail with reference to the accompanying drawings.

DETAILED DESCRIPTION

Figure 1:
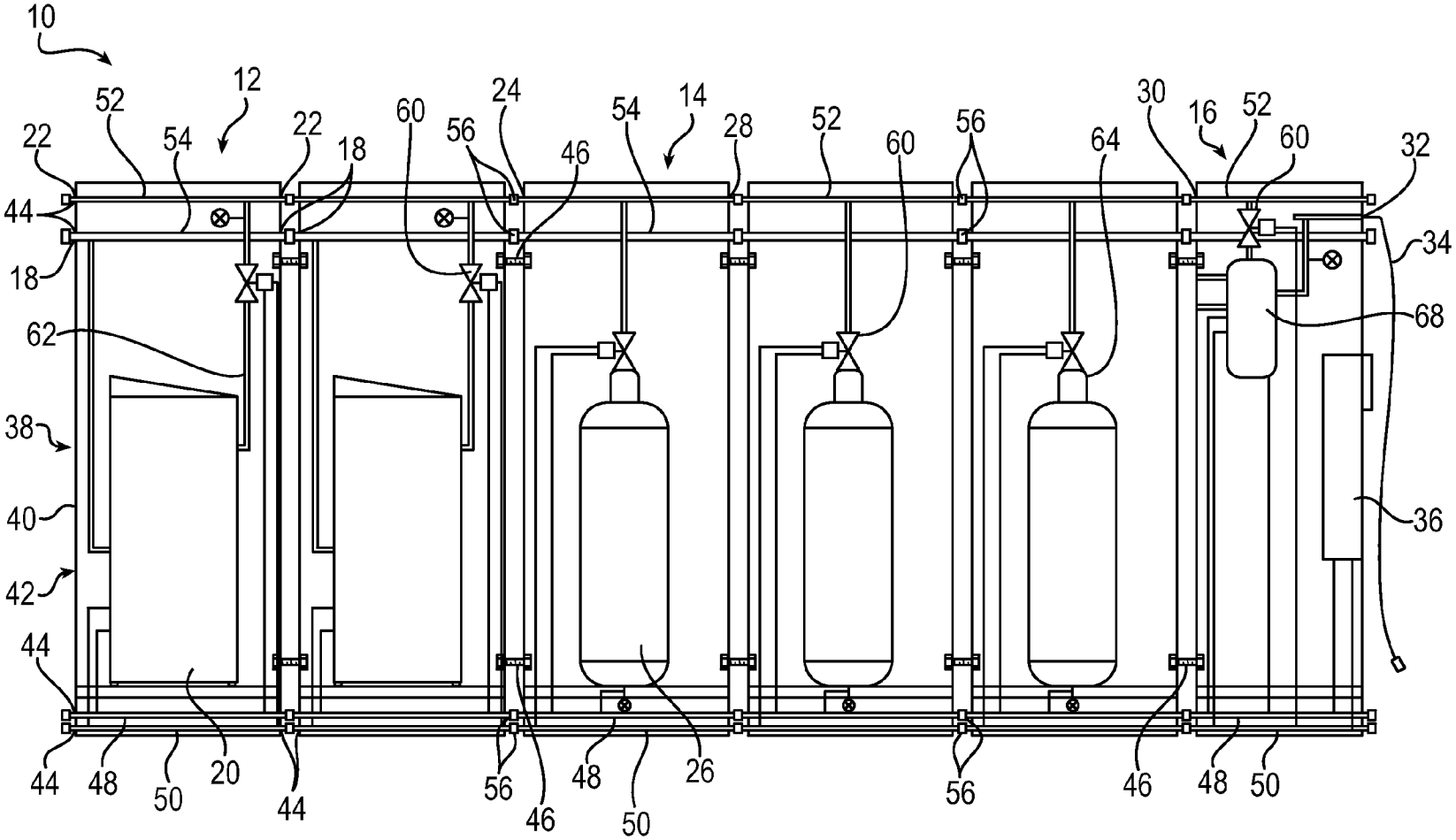
FIG. 1 is cross-sectional view of an exemplary CNG refilling station including compression, storage and control units that are arranged in stacked relationship in accordance to the invention.

The present embodiments generally relate to a compressed natural gas (CNG) refilling station that is scalable and reconfigurable. A CNG refilling station according to the present invention may include compression units, storage units and/or control units that may be assembled together in any order or quantity to form a gas refilling station of any size. The units may be assembled on-site and may easily be attached, removed or reconfigured. Once the units are assembled, a control unit (or units) may automatically communicate with all the other units to work as a single gas refilling station. The design allows for reconfiguration, where additional units can be added to increase compression, storage, or dispenser capacity as needed. The design also allows for units to be easily replaced and/or maintained and arranged to accommodate for location constraints.

FIGS. 1-8 show two exemplary embodiments of reconfigurable and scalable fluid distribution systems 10 that include one or more compression units 12, one or more storage units 14 and one or more control units 16. The FIGS. 1-4 embodiment employs a distributed dispensing framework wherein storage tank control valves are located in respective storage units whereas the FIGS. 5-8 embodiment employs a standalone dispensing framework wherein the storage tank control valves are located in the control unit.

The compression unit 12 includes an inlet 18 for receiving fluid from a fluid source, a compressor 20 for compressing the fluid, and an outlet 22 through which the compressed fluid exits the compression unit 12. The compression unit 12 may also include a dryer for removing moisture from the incoming fluid. The dryer may be, for example, a desiccant dryer or a deliquescent dryer. The storage unit 14 includes an inlet 24 for receiving compressed fluid, a storage tank 26 for storing the compressed fluid, and an outlet 28 through which the compressed fluid exits the storage unit.

The control unit 16 includes an inlet 30 for receiving compressed fluid from the one or more storage units 14 and/or the one or more compression units 12, an outlet 32 through which the compressed fluid exits to a dispensing hose 34, and a controller 36 for communicating with the one or more compression units 12 and/or the one or more storage units 14 and/or the one or more control units 16. The controller 36 may also communicate with a cloud-based management system configured to remotely oversee the operation of multiple systems 10. The cloud-based system may, for example, integrate gas refilling stations with map software, indicate current availability of dispensable gas at each station, keep a maintenance log of each station, keep a real-time log of gas dispensed daily for each station, warn a designated operation manager of potential problems and emergency shutdown events, and provide different levels of user access.

The one or more compression units 12, one or more storage units 14 and one or more control units 16 are configured to be in fluid, electronic and electrical communication with one another. The units 12, 14 and 16 are also configured to be coupled together in a stacked relationship, each in abutting relation to the next. The units 12, 14 and 16 are also configure to allow additional compression, storage and/or control units to be coupled in abutting relationship to an existing stack of coupled units. The control unit 16 may be configured to automatically detect and communicate with all the other units in the system 10 when the units 12, 14 and 16 are coupled together.

The one or more compression units 12, one or more storage units 14 and one or more control units 16 may include a housing 38. The housing 38 may include a frame 40 and sheathing 42. The sheathing 42 may include apertures 44. The apertures 44 may be arranged in a pattern such that, when one unit is coupled to another unit in a stacked, abutting relationship, the apertures 44 of one unit align with the apertures of the other unit. The housing 38 may further include a roof to protect the components and connections within the unit from the elements. The roof may be ventilated to allow for the escape of fluid in case of a leak.

The one or more compression units 12, one or more storage units 14 and one or more control units 16 may be configured to be coupled together via mechanical connections 46 between their respective housings 38. The mechanical connections 46 may be, for example, suitable fasteners, such as bolts, or connectors, such as quick-connect (and preferably also quick-disconnect) connectors.

The one or more compression units 12, one or more storage units 14 and one or more control units 16 may be ventilated to prevent the accumulation of gas in case of leaks. For example, vents may be provided in the housing 38 at the top and bottom of the units to allow gas to vent out in case of a leak and air to replace the gas.

The one or more compression units 12, one or more storage units 14 and one or more control units 16 may further include a power supply conduit 48, a data conduit 50, a pipe 52 for compressed fluid, and a pipe 54 for fluid from the fluid source. The one or more compression units 12, one or more storage units 14 and one or more control units 16 may be configured to be placed into fluid, electronic and electrical communication with one another via connections 56 between their respective conduits 48, 50 and pipes 52, 54. The connections 56 may include couplings 58 configured to automatically connect when one unit is brought into stacked, abutting relationship to another. The connections 56 and/or conduits 48, 50 and pipes 52, 54 may extend out of the apertures 44.

The one or more compression units 12, one or more storage units 14 and one or more control units 16 may include one or more control valves 60. The control valves 60 may be configured to be controlled by the controller 36 to direct the flow of fluid through the system 10. The control valves 60 may be, for example, solenoid valves. As above mentioned, the control valve associated with each storage tank is located in the respective storage unit in the FIGS. 1-4 embodiment whereas the storage tank control valves in the FIGS. 5-8 embodiment are located in the control unit.

In the one or more compression units 12, a control valve 60 may be located at an outlet 62 of the compressor 20. The control valves 60 may be configured to be controlled by the controller 36 to allow compressed fluid to exit the compressor 20. The controller 36 may further be configured to turn the compressor 20 on and off. The control valves 60 may be, for example, solenoid valves.

In other embodiments, a control valve 60 may be located at an inlet of the storage tank 26 and/or at an outlet of the storage tank 26. The control valves 60 may be configured to be controlled by the controller 36 to allow compressed fluid to enter/exit the storage tank 26. The control valves 60 may be, for example, solenoid valves.

The system 10 may be assembled by coupling the one or more compression units 12, one or more storage units 14 and one or more control units 16 together in a stacked relationship, each in abutting relation to the next and placing the one or more compression units 12, one or more storage units 14 and one or more control units 16 into fluid, electronic and electrical communication with one another.

The coupling step may further include connecting the units mechanically via the housing 38 of each unit. The units may be mechanically connected using the mechanical connections 46.

The placing step may further include connecting the units fluidically, electronically and electrically via the power supply conduit 48, the data conduit 50, the pipe 52 for compressed fluid and the pipe 54 for fluid from the fluid source disposed in the units. The control unit 16 may be configured to automatically detect and communicate with other units in the system 10 when the units 12, 14 and 16 are coupled together and placed into communication with one another. The electrical, fluid and mechanical connections may all be effected essentially simultaneously when the units are stacked against each other.

To distribute fluid via a reconfigurable and scalable fluid distribution system 10, the one or more compression units 12, one or more storage units 14 and one or more control units 16 are placed into fluid, electronic and electrical communication with one another. The units are then connected together in a stack, each in abutting relation to the next. A fluid source is connected to the stack, and the fluid is then compressed using the one or more compression units 12. The compressed fluid is then stored in the one or more storage units 14. The compressed fluid is then distributed from the one or more control units 16. Control valves 60 disposed in the one or more compression units 12 and one or more storage units 14 may be operated to control the compression, storage and distribution of the fluid using a controller 36 disposed in a control unit 16. The control unit 16 may be configured to automatically detect and communicate with other units in the system 10 when the units 12, 14 and 16 are coupled together and placed into communication with one another.

Figure 5:
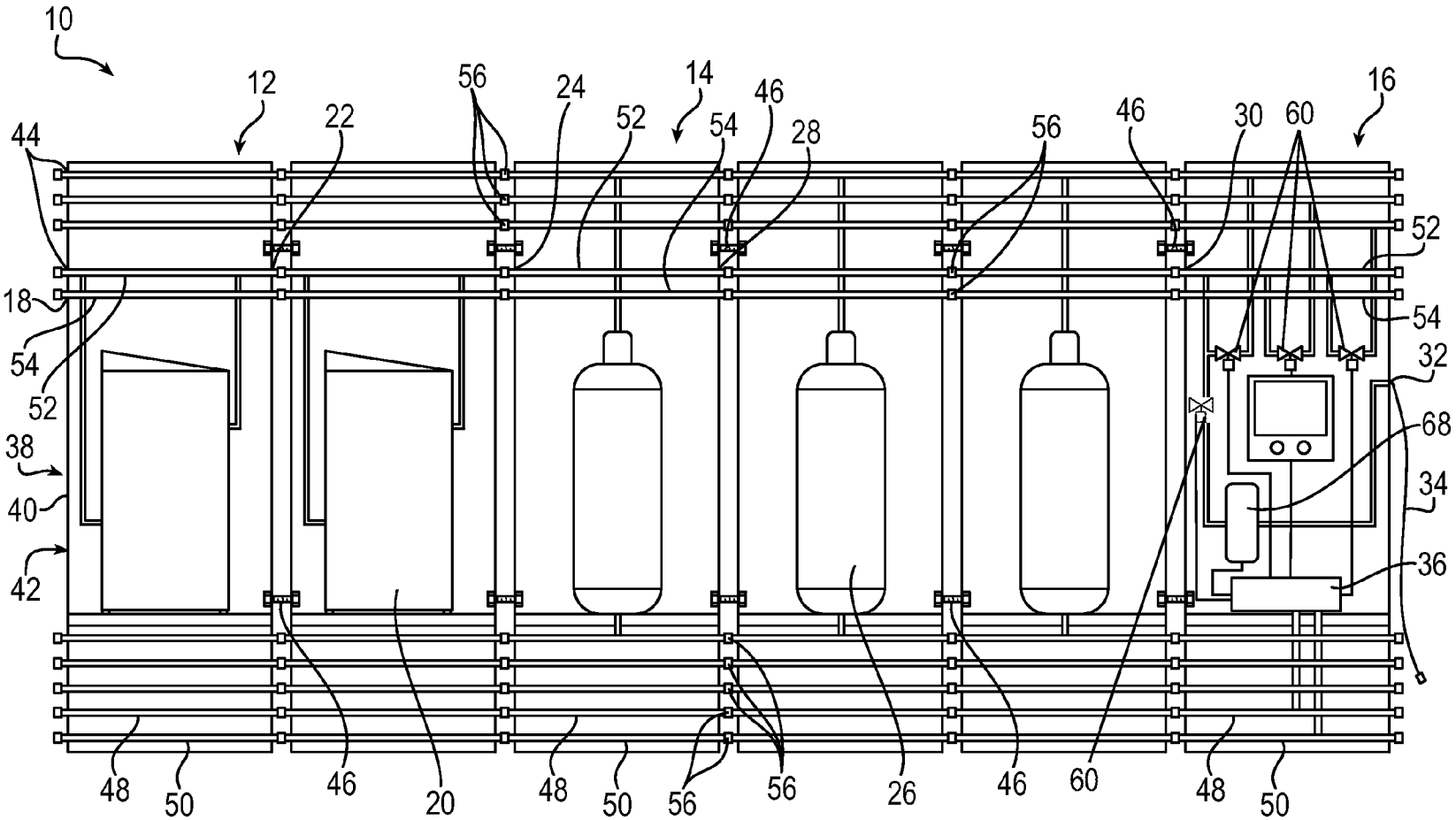
FIG. 5 is a cross-sectional view of another exemplary CNG refilling station according to the invention.
Figure 8:
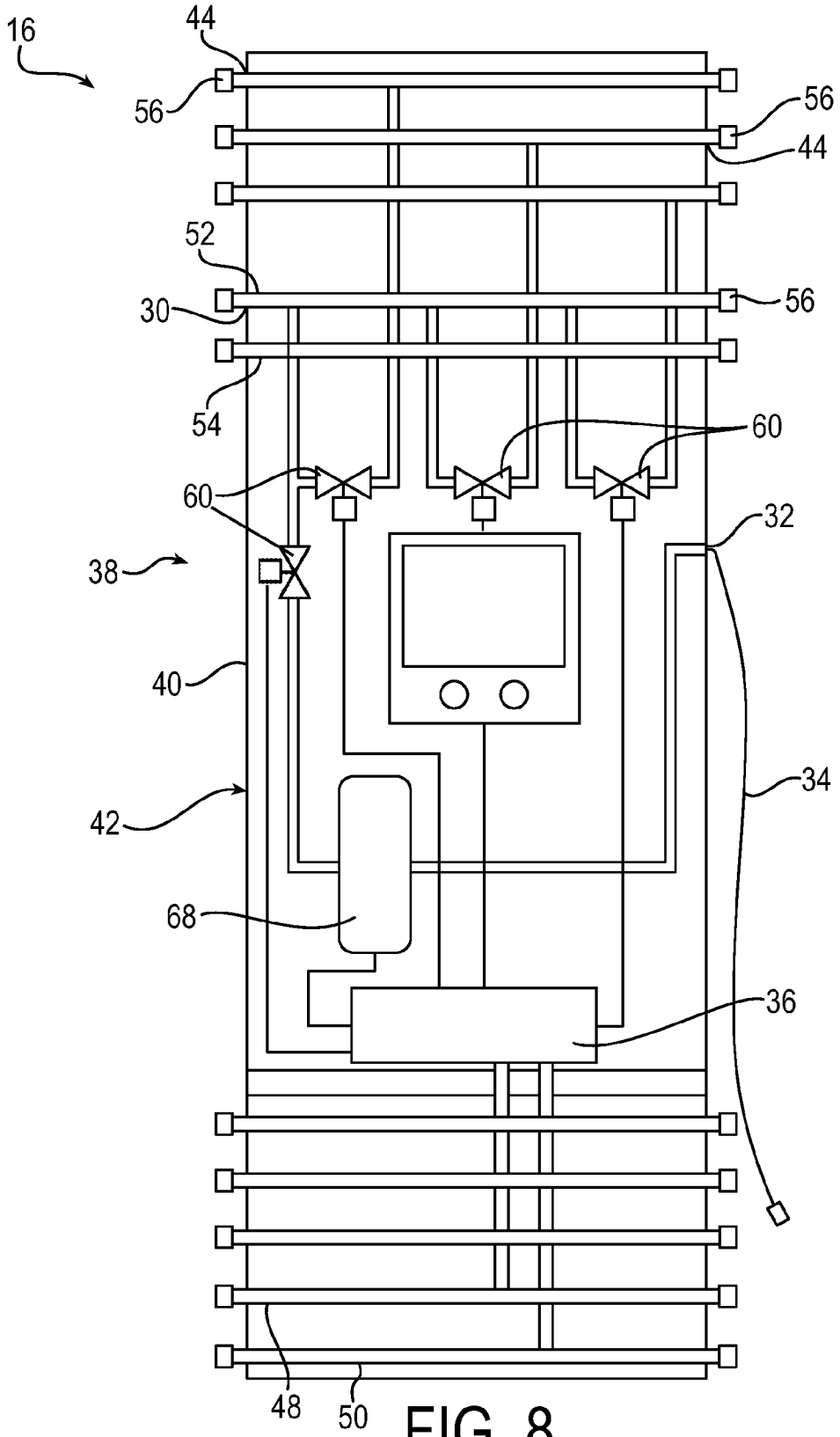
FIG. 8 is a cross-sectional view of a control unit used in the refilling station of FIG. 5.

The control unit shown in FIGS. 5 and 8 includes a housing 38. The housing 38 may include an inlet 30 for receiving compressed fluid from one or more storage tanks 26 and/or one or more compressors 20 and an outlet 32 through which the compressed fluid may exit to a dispensing hose 34. The control unit 16 may also include a mass flow meter 68 disposed in the housing 38 for measuring the amount of fluid exiting the outlet 32. The control unit 16 may also include one or more valves 60 disposed in the housing 38 for controlling the flow of fluid into and out of the one or more storage tanks 26 and/or out of the one or more compressors 20. The control unit also includes a dispensing control valve in the line connecting the compressed fluid pipe to the mass flow meter 68 to control the dispensing of compressed fluid through the dispensing hose 34. The control unit 16 may also include a controller 36 disposed in the housing 38 for controlling the one or more valves 60. The control valves 60 may be, for example, solenoid valves. The controller 36 may also communicate with a cloud-based management system configured to remotely oversee the operation of multiple systems 10. The cloud-based system may, for example, integrate gas refilling stations with map software, indicate current availability of dispensable gas at each station, keep a maintenance log of each station, keep a real-time log of gas dispensed daily for each station, warn a designated operation manager of potential problems and emergency shutdown events, and provide different levels of user access. The housing 38 may further include a frame 40 and sheathing 42, and the sheathing 42 may include apertures 44. The housing 38 may further include a roof to protect the components and connections within the unit from the elements. The roof may be ventilated to allow for the escape of fluid in case of a leak.

The control unit 16 may be configured to be in fluid, electronic and electrical communication with one or more compression units 12 and one or more storage units 14. As shown in FIGS. 1 and 5, the units may be connected fluidically, electronically and electrically via a power supply conduit 48, a data conduit 50, a pipe 52 for compressed fluid and a pipe 54 for fluid from the fluid source disposed in each unit. The connections 56 may include couplings 58 configured to automatically connect when one unit is brought into stacked, abutting relationship to another. The connections 56 and/or conduits 48, 50 and pipes 52, 54 may extend out of the apertures 44. The control unit 16 may be configured to automatically detect and communicate with other units in the system 10 when the units 12, 14 and 16 are coupled together and placed into communication with one another.

The compression unit 12 may include an inlet 18 for receiving fluid from a fluid source, a compressor 20 for compressing the fluid, and an outlet 22 through which the compressed fluid may exit the compression unit 12. The compression unit 12 may also include a dryer for removing moisture from the incoming fluid. The dryer may be, for example, a desiccant dryer or a deliquescent dryer. The storage unit 14 includes an inlet 24 for receiving compressed fluid, a storage tank 26 for storing the compressed fluid, and an outlet 28 through which the compressed fluid may exit the storage unit 14. The control unit 16 may be configured to be coupled together in a stacked relationship with the one or more storage units 14 and/or one or more compression units 12, each in abutting relation to the next. Each of the one or more compression units 12, one or more storage units 14 and one or more control units 16 may be ventilated to prevent the accumulation of gas in case of leaks. For example, vents may be provided in the housing 38 at the top and bottom of the units to allow gas to vent out in case of a leak and air to replace the gas.

Figure 2:
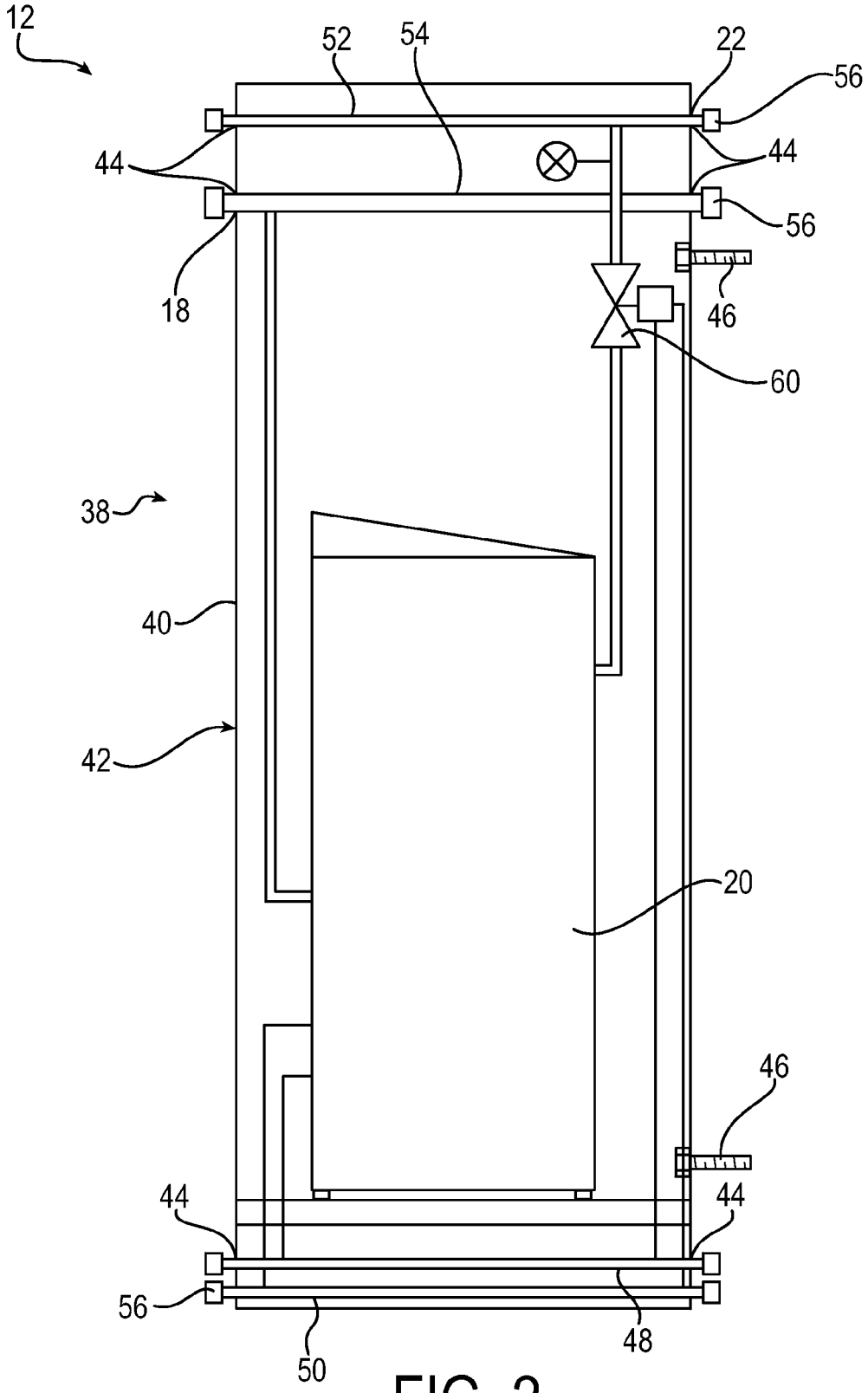
FIG. 2 is a cross-sectional view of an exemplary compression unit according to the invention.
Figure 3:
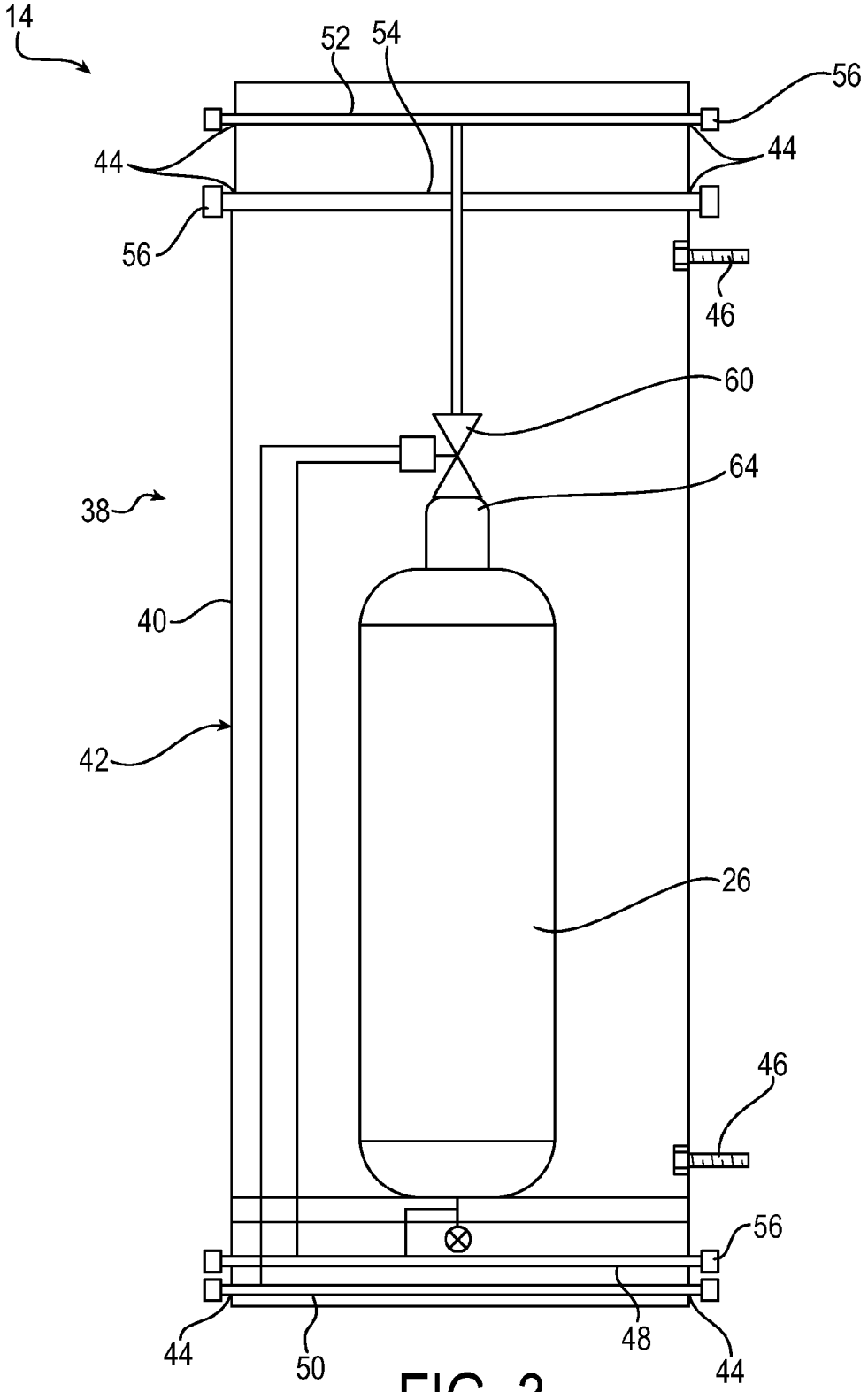
FIG. 3 is a cross-sectional view of an exemplary storage unit according to the invention.
Figure 4:
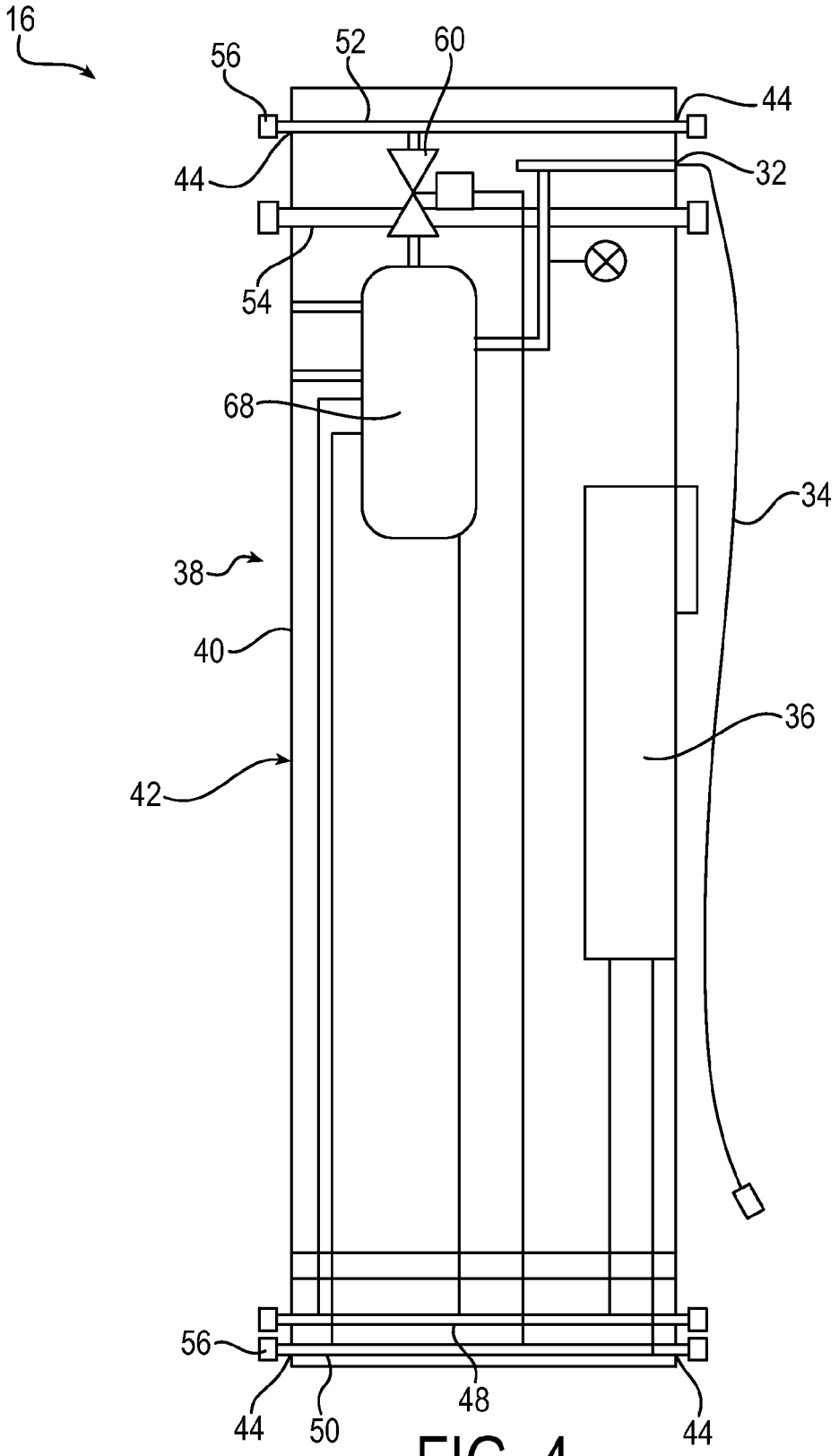
FIG. 4 is a cross-sectional view of an exemplary control unit according to the invention.
Figure 6:
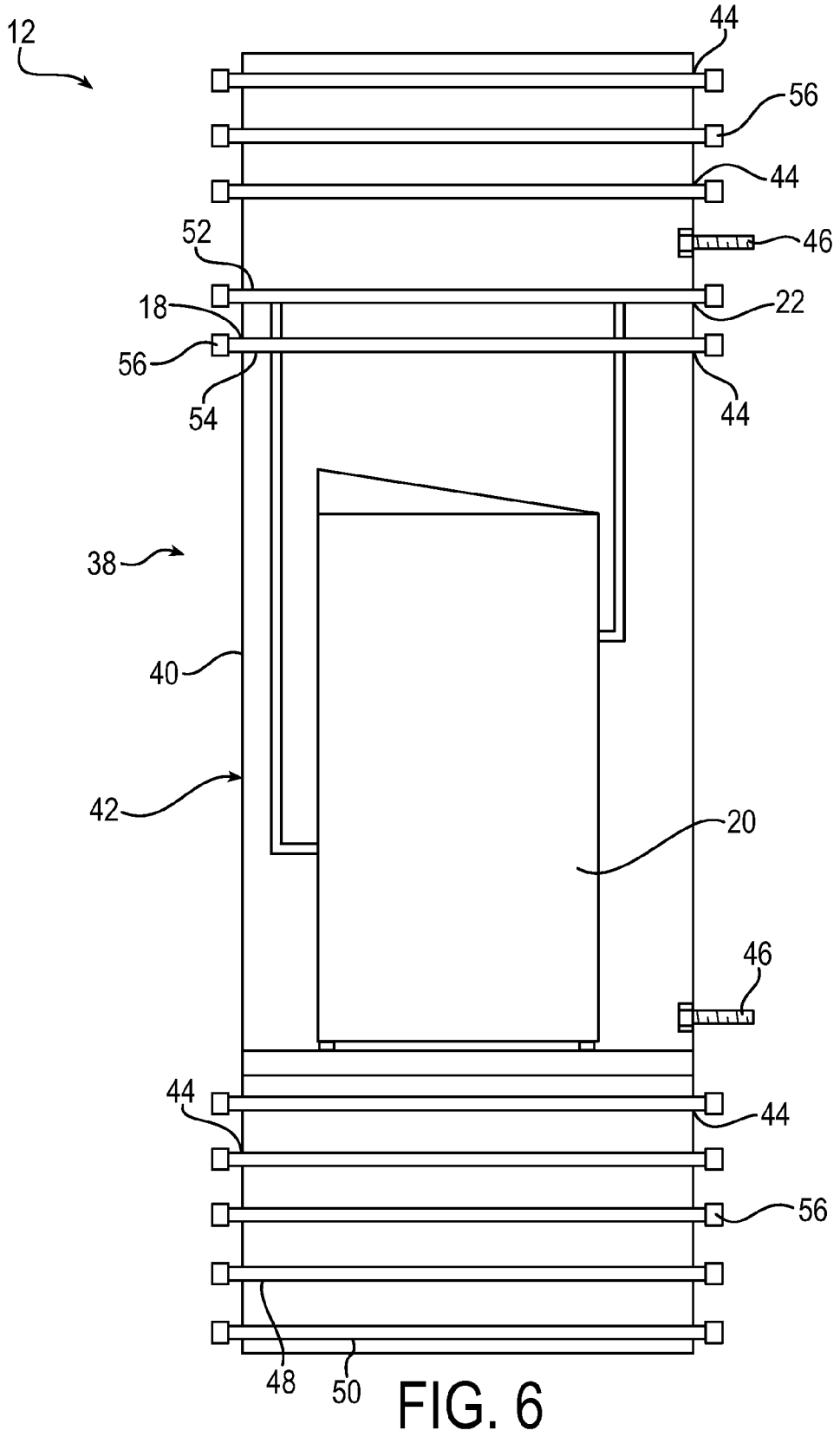
FIG. 6 is a cross-sectional view of a compression unit used in the refilling station of FIG. 5.
Figure 7:
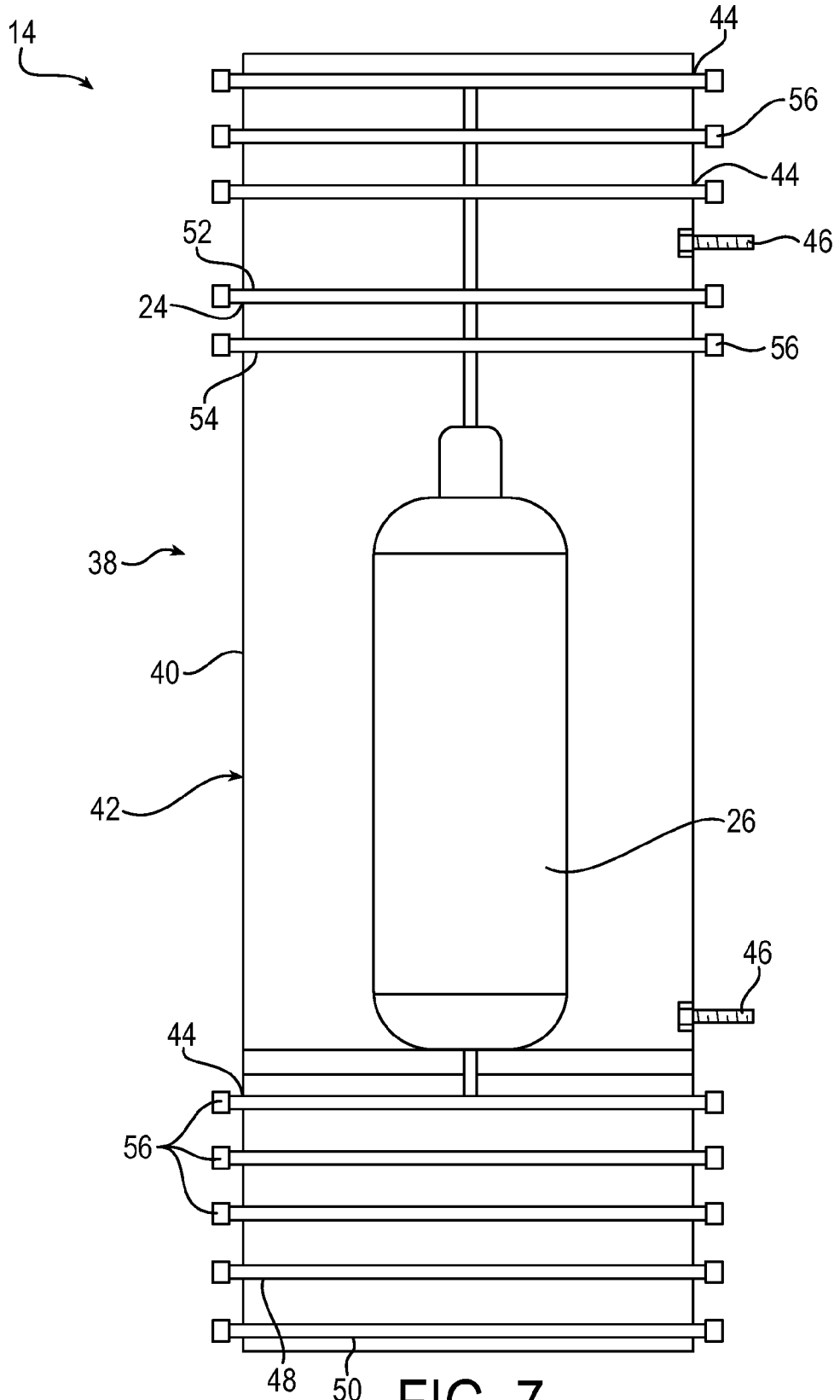
FIG. 7 is a cross-sectional view of a storage unit used in the refilling station of FIG. 5.

As shown in FIGS. 2 and 6, the compression unit 12 for a reconfigurable and scalable fluid distribution system 10 includes a housing 38. The housing 38 may include a frame 40 and sheathing 42 and an inlet 18 for receiving fluid from a fluid source and an outlet 22 through which compressed fluid may exit the compression unit 12. The sheathing 42 may include apertures 44. The housing 38 may further include a roof to protect the components and connections within the unit from the elements. The roof may be ventilated to allow for the escape of fluid in case of a leak. The compression unit 12 may further include a compressor 20 disposed within the housing 38 for compressing the fluid. Each compression unit 12 may also include a dryer for removing moisture from the incoming fluid. The dryer may be, for example, a desiccant dryer or a deliquescent dryer. The compression unit 12 may further include a power supply conduit 48, a data conduit 50, a pipe 52 for compressed fluid, and a pipe 54 for fluid from the fluid source disposed within the housing 38. The compression unit 12 may be configured such that multiple compression units 12 may be placed in fluid, electronic and electrical communication with one another. The units may be connected fluidically, electronically and electrically via a power supply conduit 48, a data conduit 50, a pipe 52 for compressed fluid and a pipe 54 for fluid from the fluid source disposed in each unit. The connections 56 may include couplings 58 configured to automatically connect when one unit is brought into stacked, abutting relationship to another. The connections 56 and/or conduits 48, 50 and pipes 52, 54 may extend out of the apertures 44. The compression unit 12 may be further configured such that multiple compression units 12 may be mechanically coupled together via the housing 38 in a stacked relationship, each in abutting relation to the next. The units may be mechanically coupled using, for example, suitable fasteners, such as bolts, or connectors, such as quick-connect connectors. Each of the one or more compression units 12 may be ventilated to prevent the accumulation of gas in case of leaks. For example, vents may be provided in the housing 38 at the top and bottom of the units to allow gas to vent out in case of a leak and air to replace the gas.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A reconfigurable and scalable fluid distribution system comprising:

a compression unit comprising an inlet for receiving fluid from a fluid source, a compressor for compressing the fluid, and an outlet through which the compressed fluid exits the compression unit;

a storage unit comprising an inlet for receiving compressed fluid, a storage tank for storing the compressed fluid, and an outlet through which the compressed fluid exits the storage unit; and a control unit comprising an inlet for receiving compressed fluid, an outlet through which the compressed fluid exits to a dispensing hose, and a controller for communicating with the compression unit and the storage unit, wherein the compression unit, the storage unit and the control unit are configured to be in fluid, electronic and electrical communication with one another and are configured to be coupled together in a stacked relationship, each in abutting relation to the next and are configured to allow additional compression, storage and/or control units to be coupled in abutting relationship to an existing stack of coupled units, and wherein each of the compression unit, the storage unit and the control unit further comprise a housing, wherein the housing comprises a frame and sheathing, and wherein the sheathing comprises apertures arranged in a pattern such that, when one unit is coupled to another unit in a stacked, abutting relationship, the apertures of one unit align with the apertures of the other unit.

2. The system according to claim 1, wherein the units are configured to be coupled together via mechanical connections between their respective housings.

3. The system according to claim 1, wherein the compression unit, the storage unit and the control unit further comprise a power supply conduit, a data conduit, a pipe for compressed fluid, and a pipe for fluid from the fluid source.

4. The system according to claim 3, wherein the units are configured to be placed into fluid, electronic and electrical communication with one another via connections between their respective conduits and pipes.

5. The system according to claim 4, wherein the connections comprise couplings configured to automatically connect when one unit is brought into stacked, abutting relationship to another.

6. The system according to claim 1, wherein the compression unit, the storage unit and the control unit comprise a control valve configured to be controlled by the controller to direct the flow of fluid through the system.

7. The system according to claim 6, wherein the compression unit comprises a control valve at an outlet of the compressor configured to be controlled by the controller to allow compressed fluid to exit the compressor and wherein the controller is configured to turn the compressor on and off.

8. The system according to claim 6, wherein the storage unit comprises a control valve at an inlet of the storage tank and a control valve at an outlet of the storage tank, and wherein the control valves are configured to be controlled by the controller to allow compressed fluid to enter/exit the storage tank.

9. A method for assembling a reconfigurable and scalable fluid distribution system including a compression unit, a storage unit, and a control unit, the compression unit comprising an inlet for receiving fluid from a fluid source, a compressor for compressing the fluid, and an outlet through which the compressed fluid may exit the compression unit, the storage unit comprising an inlet for receiving compressed fluid, a storage tank for storing the compressed fluid, and an outlet through which the compressed fluid may exit the storage unit, and the control unit comprising an inlet for receiving the compressed fluid, an outlet through which the compressed fluid may exit to a dispensing hose, and a controller for communicating with the compression unit and the storage unit, the method comprising the steps of:

(a) coupling the compression unit, the storage unit and the control unit together in a stacked relationship, each in abutting relation to the next; and (b) placing the compression unit, the storage unit and the control unit into fluid, electronic and electrical communication with one another.

10. The method according to claim 9, wherein the coupling step further comprises connecting the units mechanically via a housing of each unit, wherein the housing comprises a frame and sheathing, and wherein the sheathing comprises apertures arranged in a pattern such that, when one unit is coupled to another unit in a stacked, abutting relationship, the apertures of one unit align with the apertures of the other unit.

11. The method according to claim 9, wherein the placing step further comprises connecting the units fluidically, electronically and electrically.

12. The method according to claim 9, wherein the compression unit, the storage unit and the control unit comprise a control valve controlled by the controller to direct the flow of fluid through the system.

13. The method according to claim 11, wherein the units are connected fluidically, electronically and electrically via a power supply conduit, a data conduit, a pipe for compressed fluid and a pipe for fluid from the fluid source disposed in each unit.

14. The method according to claim 13, wherein the connections comprise couplings configured to automatically connect when one unit is brought into stacked, abutting relationship to another.

15. A method of distributing fluid via a reconfigurable and scalable fluid distribution system comprising the steps of:

(a) placing a compression unit, a storage unit and a control unit into fluid, electronic and electrical communication with one another;

(b) connecting the units together in a stack, each in abutting relation to the next;

(c) connecting a fluid source to the stack;

(d) compressing the fluid using the compression unit;

(e) storing the compressed fluid in the storage unit; and (f) distributing the compressed fluid from the control unit.

16. The method according to claim 15, further comprising the step of:

(g) operating control valves disposed in the compression unit and storage unit to control the compression, storage and distribution of the fluid using a controller disposed in the control unit.

17. A control unit for a reconfigurable and scalable fluid distribution system comprising:

a housing having an inlet for receiving compressed fluid from a storage tank and/or a compressor and an outlet through which the compressed fluid may exit to a dispensing hose;

a mass flow meter disposed in the housing for measuring the amount of fluid exiting the outlet;

a valve disposed in the housing for controlling the flow of fluid into and out of the storage tank and/or out of the compressor; and a controller disposed in the housing for controlling the valve, wherein the control unit is configured to be in fluid, electronic and electrical communication with a compression unit and a storage unit, wherein the compression unit comprises an inlet for receiving fluid from a fluid source, a compressor for compressing the fluid, and an outlet through which the compressed fluid may exit the compression unit, wherein the storage unit comprises an inlet for receiving compressed fluid, a storage tank for storing the compressed fluid, and an outlet through which the compressed fluid may exit the storage unit, wherein the control unit, the compression unit and the storage unit are configured to be coupled together in a stacked relationship, each in abutting relation to the next, and wherein the compression unit and the storage unit further comprise a housing, wherein the housings of the control unit, compression unit and storage unit each comprise a frame and sheathing, and wherein the sheathing comprises apertures arranged in a pattern such that, when one unit is coupled to another unit in a stacked, abutting relationship, the apertures of one unit align with the apertures of the other unit.

18. A compression unit for a reconfigurable and scalable fluid distribution system comprising:

an inlet for receiving fluid from a fluid source;

a compressor for compressing the fluid; and an outlet through which the compressed fluid may exit the compression unit, wherein the compression unit is configured to be in fluid, electronic and electrical communication with a control unit and a storage unit, wherein the storage unit comprises an inlet for receiving compressed fluid, a storage tank for storing the compressed fluid, and an outlet through which the compressed fluid may exit the storage unit, wherein the control unit comprises an inlet for receiving compressed fluid, an outlet through which the compressed fluid exits to a dispensing hose, and a controller for communicating with the compression unit and the storage unit, wherein the control unit, the compression unit and the storage unit are configured to be coupled together in a stacked relationship, each in abutting relation to the next, and wherein each of the compression unit, the storage unit and the control unit further comprise a housing, wherein the housing comprises a frame and sheathing, and wherein the sheathing comprises apertures arranged in a pattern such that, when one unit is coupled to another unit in a stacked, abutting relationship, the apertures of one unit align with the apertures of the other unit.

19. A storage unit for a reconfigurable and scalable fluid distribution system comprising:

an inlet for receiving compressed fluid;

a storage tank for storing the compressed fluid; and an outlet through which the compressed fluid exits the storage unit, wherein the storage unit is configured to be in fluid, electronic and electrical communication with a control unit and a compression unit, wherein the control unit comprises an inlet for receiving compressed fluid, an outlet through which the compressed fluid exits to a dispensing hose, and a controller for communicating with the compression unit and the storage unit, wherein the compression unit comprises an inlet for receiving fluid from a fluid source, a compressor for compressing the fluid, and an outlet through which the compressed fluid may exit the compression unit, wherein the control unit, the compression unit and the storage unit are configured to be coupled together in a stacked relationship, each in abutting relation to the next, and wherein each of the compression unit, the storage unit and the control unit further comprise a housing, wherein the housing comprises a frame and sheathing, and wherein the sheathing comprises apertures arranged in a pattern such that, when one unit is coupled to another unit in a stacked, abutting relationship, the apertures of one unit align with the apertures of the other unit.

* * * * *